United States Patent [19]

Wertz et al.

[11] Patent Number: 4,949,417

[45] Date of Patent: Aug. 21, 1990

[54] ABRASIVE PAD, WHICH CAN BE SUBSTITUTE FOR A STEEL WOOL PAD, AND/OR SCOURING PAD AND PROCESS FOR PRODUCING SAME

[75] Inventors: Jean-Luc Wertz, Beauvais; Jacques Baudonnel, Ons-en-Bray, both of France

[73] Assignee: Spontex Incorporated, New Rochelle, N.Y.

[21] Appl. No.: 273,822

[22] Filed: Nov. 21, 1988

Related U.S. Application Data

[63] Continuation-in-part of Ser. No. 159,707, Feb. 24, 1988, Pat. No. 4,856,134.

[30] Foreign Application Priority Data

Jan. 27, 1988 [FR] France ..... 88 00947

[51] Int. Cl.[5] ..... A47L 17/08

[52] U.S. Cl. ..... 15/104.93; 15/105; 15/118; 15/209 B; 51/402; 51/407; 156/213; 156/250

[58] Field of Search ..... 15/104.93, , 104.94, 15/105, 118, 209 R, 209 B, 244.3, 244.4; 156/213, 250; 51/402, 407

[56] References Cited

U.S. PATENT DOCUMENTS

| | | | |
|---|---|---|---|
| 3,038,187 | 6/1962 | Nathanson | 15/209 B |
| 3,040,353 | 6/1962 | Gray | 15/244.3 |
| 3,638,270 | 2/1972 | Schlegel et al. | 15/244.3 |
| 3,849,225 | 11/1974 | Haertle | 15/244.3 |

FOREIGN PATENT DOCUMENTS

| | | | |
|---|---|---|---|
| 2063058 | 6/1981 | United Kingdom | 15/244.3 |

*Primary Examiner*—Philip R. Coe
*Assistant Examiner*—M. Spisich

[57] ABSTRACT

An abrasive and/or scouring pad, comprising a core of foam between two nonwovens, wherein the core is a polyurethane foam and the nonwovens are based on a mixture of polyamide and polyester fibers. The polyamide has physical properties similar to those of the polyurethane foam. The nonwovens and the foam are bonded together at their periphery by thermal-welding, either directly, or by two layers of heat-fusible or heat-softening material placed on either side of the foam.

18 Claims, 2 Drawing Sheets

ABRASIVE PAD, WHICH CAN BE SUBSTITUTE FOR A STEEL WOOL PAD, AND/OR SCOURING PAD AND PROCESS FOR PRODUCING SAME

CROSS-RELATED APPLICATION This application is a continuation-in-part of serial No. 159,707 filed Feb. 24, 1988, now patent No. 4,856,134.

FIELD OF THE INVENTION

The present invention relates to the field of cleaning in general and more particularly to an abrasive pad, substitute for steel wool, and/or scouring pad. The invention also relates to a process for obtaining such pad.

BACKGROUND OF THE INVENTION

Steel wool has been used for a long time in pad form for scouring kitchen utensils such as cooking pots and pans.

These steel wool pads, however, have the disadvantage of rusting, of disintegrating quickly, and of being difficult to clean. Moreover, they are unpleasant to the touch.

SUMMARY OF THE INVENTION

It is now one object of the present invention to provide a pad which is abrasive on both faces and which constitutes a substitute for steel wool, without any of its disadvantages, and which, in particular, will last longer, while preserving its original aspect and properties.

The invention also provides scouring or mixed pads, i.e. pads that are scouring on one face and abrasive on the other.

The abrasive and/or scouring pad according to the invention is composed of a core of foam between two nonwovens. The term "nonwoven" is used in the art to refer to sheets or webs of materials which are bonded together and not woven. Its characteristics are as follows:

said core is a polyurethane foam;

the nonwovens are based on an mixture of polyamide and polyester fibers, the polyamide having physical properties similar to those of said polyurethane foam;

said nonwovens and foam are bonded together at their periphery by thermal-welding either directly or by means of two layers of heat-fusible or heat softening material placed on either side of said foam.

The specific nature of the materials composing the pad according to the invention gives it advantageous properties as regards its cleaning and scouring action, with the added possibility for said pad of being produced by thermal-welding (or thermal-sealing), which is a very reliable method. Indeed, the thermal-welding produced with such material is strong, non-brittle and has no sharp edges, nor has it any tendency to break off.

Therefore, the pad according to the invention can exist as two variant embodiments:

either it comprises the core of foam between the two nonwovens, or it comprises the core of foam between the layers of heat-fusible or heat-softening material, and the resulting assembly is contained between the two nonwovens.

The foam used is a polyurethane foam whose composition is based on polyols and isocyanates.

Said foam constitutes the core of the pad. It is stabilized inside the pad since it is bonded to the two nonwovens over its periphery.

The foam may contain a filler. According to a preferred variant of the invention, said filler consists of soap particles. Said particles may be of variable granulometry.

The action of said soap particles, throughout the formation of the foam, causes a slight modification of the physical properties thereof.

Thus, on an industrial level, it is often difficult to guarantee a really constant polyurethane quality, in particular when fillers, such as soap for example, are used in the production of said foam. This explains why the second variant according to the invention calls on the use of heat-fusible or heat-softening materials. In this way, the reliability of the seal is guaranteed with polyurethane foams of slightly fluctuating quality.

Suitable materials for constituting the intermediate layers of the pad according to the invention are meltable materials or materials which at least soften at the pad thermoshaping temperature.

They are intended to act as an auxiliary bonding agent, namely as a "sealability regulating agent".

Advantageously, said materials are "pure" products, whose thermal properties are perfectly controllable. They are, for example:

layers of polyurethane foam, such as polyurethane polyester, polyurethane-polyether, . . .

thermoplastic films such as polyethylene films, layers of fibers, such as fibers containing polypropylene, polyester, . . .

Any material adapted to serve as a bonding agent at the pad thermoshaping temperature, is suitable.

Obviously, the same material is advantageously used for constituting the two intermediate layers.

However, the use of materials of different nature on either side of the foam is not excluded according to the invention.

In the case when the core of the pad contains fillers to be extracted, for example, soap, said material(s) must be permeable in order to allow the release of said fillers with the water, during use.

Therefore, when thermoplastic films are used with a filled foam, perforations will have to be made in said films.

Such intermediate layers of heat-fusible or heat-softening materials will be advantageously used, as specified hereinabove, around soap-filled foams, for which a constant quality is often difficult to obtain.

The intermediate layers insure a good sealability of the pad and, moreover, in this particular case, they slow down the soap extraction process. They also ensure a certain retention. This variant of the invention enables a certain control of the soap removal process, by avoiding substantial initial losses of soap.

Suitable nonwovens according to the invention are webs containing a mixture of polyamide/polyester fibers. Polyamide has physical properties—melting point—similar to those—softening temperature—of the optionally filled polyurethane foam.

The fibers composing the nonwovens have been selected, according to the invention, for their mechanical properties—resistance to abrasion, mechanical strength—and for their physical characteristics—heat—fisibility—. Said fibers are polyamide and polyester fibers.

Polyamide fibers exhibit a good resistance to abrasion and a good mechanical resistance. Polyester fibers also exhibit a good resistance to abrasion with a high mechanical resistance. The fibers selected according to the invention preferably have a unit weight less than 50 dtex. The term "weight" of a fiber is used to mean "mass per unit length" and is measured in decitex (grams per 10,000 meters). Such fibers have a good covering rate and produce supple non-wovens which are not unpleasant to the touch.

For practical reasons, the usable polyamide fibers generally have a unit weight ranging between 6.7 and 44 dtex, and the polyester fibers a unit weight ranging between 4.4 and 40 dtex.

The physical properties of these fibers are fundamental. They enable the formation by thermal-welding of a supple bond at the periphery of the pad.

Polyamide, which has the lowest transformation temperatures—melting point—is used as a bonding agent. The melting point of polyamide is actually within the range of the transformation temperatures—softening—of the polyurethane foam.

Therefore, a heating to the adequate temperature, during the welding operation, causes the formation of an intimate "liquid" mixture of polyamide and polyurethane, within which mixture the polyester fibers begin to soften. Indeed, the polyester fibers are more heat-resistant than the polyamide fibers. It is then possible to obtain a reliable bond, which has a certain suppleness and also enables the stabilization of the foam inside the pad.

According to the invention, the materials are judiciously selected: polyamide, polyester, polyurethane foam. The combination of these materials, by a simple technique, gives abrasive and/or scouring pads of high performance.

It is also possible, for the reasons explained above, to include an auxiliary bonding agent, i.e. the layers of heat-fusible or heat-softening material.

Advantageously, the nonwovens are based on a mixture containing 50 to 90% by weight of polyamide fibers and 50 to 10% by weight of polyester fibers. The quantites of polyamide and polyester used can indeed be optimized, as a function of the target results, in particular where the bonding is concerned.

On this point, it has been found that polyamide acts as a bonding agent and polyester as a suppling agent.

Preferably, the nonwovens are based on a mixture containing about 80% by weight of polyamide fibers and about 20% by weight of polyester fibers.

Regarding the fibers used, the Applicant has also shown the advantage that there is in using, in the proportions by weight indicated above, polyester fibers of low unit weight and/or mixtures of polyester fibers, and more particularly polyamide fibers, of different unit weights.

When using polyester fibers of low unit weight, a greater quantity of fibers is used, given then a very special homogeneousness and a remarkable suppleness of the material throughout its surface and also in the welding. For example, polyester fibers of unit weight between 4.4 and 17 dtex, ends included, are advantageously used.

Similarly, by mixing polyamide fibers of at least two different weights, it is possible—the bonding factor at joint level being identical—to improve the surface condition of the pad.

Advantageously, fibers of polyamide 6 are used in the nonwovens of the pads according to the invention. However, other polyamide fibers may also be used. It is necessary, as indicated hereinabove, that the polyamide used has similar physical properties to those of the selected polyurethane foam.

The melting point of said polyamide must actually be in the range of the softening temperatures of said foam.

It is specified, by way of indication, that the nonwovens contained in the pads according to the invention, can advantageously be based on a mixture of:

20% by weight of fibers of polyamide 6 of 44 dtex,
60% by weight of fibers of polyamide G of 22 dtex,
20% by weight of polyester fibers of 17 dtex.

The nonwovens constituting the faces of the pads according to the invention, based on the above-referred mixtures of fibers, are pre-bonded mechanically before being chemically-bonded, preferably with a synthetic latex such as, for example, a thermal-setting latex.

Said chemical binder is designed to give to the mixture of fibers a fairly high internal cohesion without however causing obstruction in the welding plane, during the thermal-welding operation. The quantity used, therefore, should be controlled. The weight to binder deposited with respect of the weight of fibers should be between 0.2 and 0.6. Said weight generally varies between 10 and 60 g/m$^2$ (in dry weight).

A bonded web of fibers is thus obtained after heating.

Said web can be used as is, to constitute the faces of a scouring pad according to the invention. It is however, generally preferred to subject it to a further treatment, i.e. to a spraying of a formulation, possibly containing abrasive fillers. Such formulation is normally based on a synthetic latex: phenolic resin or acrylic latex.

This spraying, which is quite controlled, can only be applied to one face of the nonwoven, i.e. the face intended to constitute the outer surface of the pad. Also, assuming that the formulation contains abrasive fillers, it is important that it should not penetrate deeply into the nonwoven. Both these conditions should be met in order to obtain a reliable and regular welding at the periphery of the pad.

Whether or not abrasives are used, in great or small quantities, and composed of more or less hard materials, depends obviously on the properties required for the pad, and more precisely for each face of the pad according to the invention.

The pads according to the invention can, indeed, have either two abrasive faces, or only one abrasive face or no abrasive face. It is merely a question of using nonwovens having on one of their faces the required surface condition.

The pads according to the invention, with abrasive fillers, are an advantageous substitute for steel wool.

The pads according to the invention, with little or no abrasive fillers, are advantageously used for scouring delicate surfaces.

Examples of suitable abrasive fillers are: silicon carbide, alumina, silica, talc or mixtures thereof.

Such abrasive fillers are deposited on the bonded web in the proportion of about 50 to about 200 g/m$^2$ (dry weight) of the formulation containing them.

It will be recalled that even without such fillers, the nonwovens based on polyamide and polyester fibers, bonded and optionally subjected to a spraying treatment, advantageously constitute either the faces or at least one of the faces of the pad according to the invention.

According to a variant embodiment of the invention, the pad also contains soap.

As indicated hereinabove, said soap contained in the pad, is advantageously distributed in the polyurethane foam, in solid form. The solid particles can be of variable granulometry. The pad according to the invention can also be coated on at least one of its outer faces, with a "film" of soap.

The present invention also relates to the process for producing pads such as described hereinabove.

Said process comprises:

producing the non-woven/foam/non-woven assembly, or the nonwoven heat-fusible or heat-softening material/foam/heat-fusible or heat-softening material nonwovens assembly in such a way that the abrasive and/or scouring faces of said non-wovens are facing outwardly;

placing the resulting assembly between the upper and lower molds of a thermoshaping tool;

thermal-welding the resulting sandwich form at a temperature within the range of the softening temperatures of the polyurethane foam and at least equal to the melting point of the polyamide fibers;

and finally, individualizing the resulting pads, by cutting.

The nonwovens are obtained, as described hereinabove, from a web of fibers, pre-bonded mechanically and chemically-bonded preferably by a synthetic latex, and optionally sprayed over with a phenolic resin. Said resin may optionally contain abrasive fillers.

The polyurethane foam is placed between said nonwovens optionally between the two layers of the heat-fusible or heat-softening material and the resulting assembly is placed between the upper and lower molds of the thermoshaping tool. Said thermoshaping tool is mounted on a press.

The shape of the molds will define the shape of the resulting pads. These can, for example, be in the form of small cushions, or cylinders, etc.

The sandwich is thermal-welded and the resulting pads are individualized by cutting.

The thermal-welding operation is carried out at a temperature close to the transformation temperatures of the polyurethane foam and of the polyamide fibers.

This creates at the periphery of the pad a zone of intimate mixture of said materials, within which the polyester fibers begin to soften. This temperature also causes the melting or at least the softening of any intermediate layers present. The compressed zone, when cooled, constitutes the bond between the two faces of the pad. The heating on the thermoshaping tool is obtained by suitable means, for example by electric elements, heat-carrying fluids, or by micro-waves or high frequency techniques, etc.

The accurate operational conditions of the thermoshaping are obviously dependent on the exact nature of the materials involved and on their thickness. Their optimization is within the scope of any one skilled in the art.

DETAILED DESCRIPTION OF THE INVENTION

The following examples are given to illustrate the invention in more detail.

Abrasive pads according to the invention are produced from a web of fibers, comprising:

20% by weight of fibers of polyamide 6 of 44 dtex,
60% by weight of fibers in polyamide 6 of 22 dtex,
20% by weight of polyester fibers of 17 dtex.

Said web weighs 90 g/m$^2$. It is impregnated in a bath with a binder—acrylic latex—containing the agents necessary for the use to be made of it.

The dry weight of latex deposited is about 40 g/m$^2$ (the ratio of the weight of latex deposited to the weight of fibers is around 0.50).

The impregnated web is dried in two ovens successively, the temperature inside these ovens reaching from 50° to 100° C.

The web is then subjected on one of its faces to a spraying operation, using to this effect a solution of phenolic resin containing a mixture of silica and alumina. In this solution, the filler/binder ratio is equal to 3. The quantity of dry product sprayed on the web is about 150 g/m$^2$. After drying, said web can be cut to the required dimensions. The web then weighs about 280 g/m$^2$, and its thickness is about 6.6 mm.

To produce a pad according to the first variant of the invention, a sandwich is made by inserting a polyurethane foam core between two layers of the aforesaid type. The thickness of the foam is 10 mm. Said foam core is filled with soap particles and shows a softing ranging between 200° and 240° C. The sandwich is thermal-welded in the molds of the thermoshaping tool mounted on a press. The essential parameters of this heat-sealing operation are as follows:

Temperature about 220° C.

Pressure$=15.10^5$ at $2.10^6$ Pa (15 to 20 bars)

Time$=1$ min

The thermal-welding temperature corresponds to the transformation temperatures of the polyamide G and the polyurethane foam, and to the start of the polyester bonding and softening zone.

The polyester fibers, having reached the softening limit, are bonded under the action of the pressure at their periphery by the polyamide-polyurethane "solution". The resulting bond is then perfectly homogeneous.

The pads are then individualized.

They are characterized by a remarkable efficiency and lasting power. They last for example four times longer than the conventional steel wool pad.

Concerning their abrasive power, this can be measured by the Taber test.

The Taber test is a test for accessing the abrasive power of the nonwovens; such assessment is performed by measuring the loss of weight of aluminum wheels, applied to the nonwovens with a certain pressure (1.5 kg), the non woven being imparted with a rotation movement.

The faces of the pad have an abrasive power of 315 mg/1000 turns (initial abrasive power at 50 turns), of 215 mg/1000 turns (abrasive power at 200 turns).

Similarly, it is possible to produce a pad according to the second variant of the invention, by thermal-welding a sandwich comprising, between the two above-described layers of nonwovens, a 8 mm-thick soap-filled polyurethane foam and two 1.4 mm-thick layers of polyurethane-polyester foam.

The polyurethane foam is the same as the one used above (softening ranging: 200°-240° C.). The polyurethane-polyester foam shows a wider softening ranging: 180°-240° C. A part of said intermediate foam is heat-fusible.

BRIEF DESCRIPTION OF DRAWINGS

The invention is illustrated in the accompanying drawings in which.

DETAILED DESCRIPTION OF THE DRAWINGS

Referring to these figures, they show at (1) and (1') the two nonwovens constituting the external faces of the pad.

The core of polyurethane foam of the pad is shown at (2). It is filled with particles of soap (4).

(3) designates the sealing plane.

Figure 1:
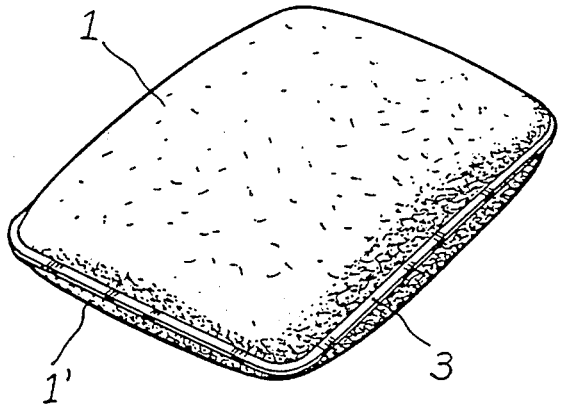
FIG. 1 is a perspective view of a pad according to the invention.
Figure 2:
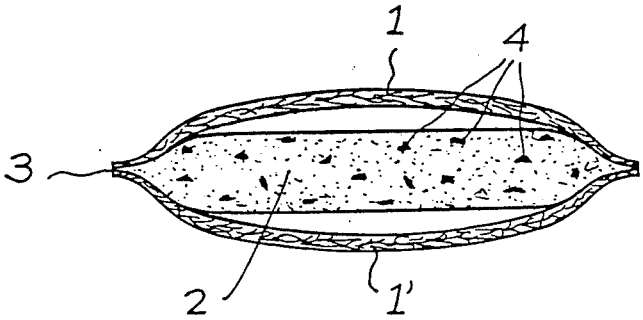
FIG. 2 is a cross-section of a pad according to first variant of the invention.

According to the first variant of the invention, illustrated in FIG. 2, the nonwovens (1) (1') and the foam core (2) and directly bonded together at their periphery.

Figure 3:
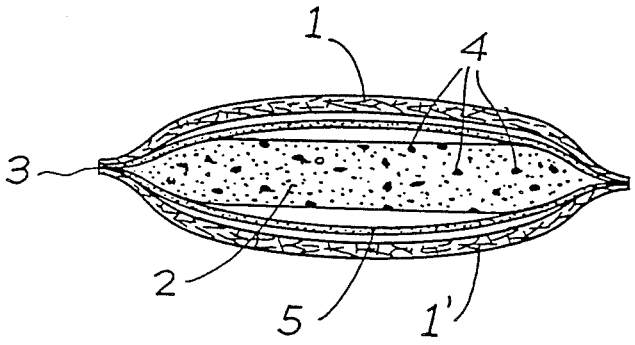
FIG. 3 is a cross-section of a pad according to the second variant of the invention.

According to the second variant, illustrated in FIG. 3, two extra layers of foam (5) are placed on either side of the core of foam (2).

What is claimed is:

1. A pad which can be abrasive, scouring or both comprising a foam core, two outer nonwoven webs sandwiching the foam core therebetween and two intermediate layers comprising one of the group consisting of a heat fusible or heat softening material between said foam core and said outer layers, said nonwoven webs comprising a mixture of polyamide and polyester fibers, said polyamide fibers having physical properties similar to those of said polyurethane foam, and a thermal weld bonding said foam core to said outer layers around the periphery of the core.

2. A pad as claimed in claim 1, wherein the polyurethane core contains soap.

3. A pad as claimed in claim 1, wherein said intermediate layers are layers of polyurethane foam of polyurethane-polyester or polyurethane-polyether type.

4. A pad as claimed in claim 1, wherein the polyamide and polyester fibers have a unit weight loss than 50 dtex.

5. A pad as claimed in claim 1, wherein the nonwoven webs comprise a mixture of 50 to 90% by weight of polyamide fibers and of 50 to 10% by weight of polyester fibers.

6. A pad as claimed in claim 1, wherein the polyester fibers have a unit weight varying between 4.4 and 17 dtex.

7. A pad as claimed in claim 1, wherein the polyamide fibers of the nonwoven webs comprise polyamide 6.

8. A pad as claimed in claim 1, wherein each nonwoven web comprises:

20% by weight of fibers of polyamide 6 to 44 dtex,
60% by weight of fibers of polyamide 6 of 22 dtex,
20% by weight of polyester fibers of 17 dtex.

9. A pad as claimed in claim 1, wherein the nonwoven webs are pre-bonded mechanically and chemically bonded by a synthetic latex; the ratio of the weight of binder to the weight of fibers being between 0.2 and 0.6.

10. A pad as claimed in claim 7, wherein the nonwoven webs are chemically bonded and sprayed with formulation abrasive fillers.

11. A pad as claimed in claim 1, wherein at least one of the two nonwoven webs comprises abrasive fillers on one face, thereof constituting an external face of the pad.

12. Process for producing pad as claimed in claim 1, wherein said process comprises:

producing a sandwich of said core and said intermediate and outer layers with outer faces of the outer nonwoven layers facing outwardly;

placing the resulting sandwich between the upper and lower molds of a thermoshaping tool;

thermal-welding the sandwich at a temperature within the range of the softening temperature of the polyurethane foam at a least equal to the melting point of the polyamide fibers;

and finally, individualizing the resulting pads, by cutting.

13. Process as claimed in claim 12, wherein the nonwoven web is formed from the fibers pre-bonded mechanically, and chemically, and on which web has been sprayed a phenolic resin.

14. A pad as claimed in claim 1 wherein said outer layers, said intermediate layers and said foam core are bonded together at the periphery of the core by said thermal weld.

15. A pad as claimed in claim 1 wherein said intermediate layers are perforated thermoplastic films or webs of fibers.

16. A pad as claimed in claim 5 wherein the nonwoven webs comprise a mixture of 80% by weight polyamide fibers and 20% by weight polyester fibers.

17. A process as claimed in claim 13 wherein said fibers of the nonwoven webs are chemically bonded by a synthetic latex.

18. A process as claimed in claim 13 wherein said phenolic resin contains abrasive fillers.

* * * * *